United States Patent [19]

De Geus

[11] 4,213,305

[45] Jul. 22, 1980

[54] SOLAR POWERED COOLING APPARATUS

[76] Inventor: Arie M. De Geus, 6625 4th St., S., St. Petersburg, Fla. 33705

[21] Appl. No.: 941,755

[22] Filed: Sep. 13, 1976

[51] Int. Cl.[2] ..... F25B 27/00; F25B 1/06

[52] U.S. Cl. ..... 62/2; 62/500

[58] Field of Search ..... 62/2, 500; 60/641

[56] References Cited

U.S. PATENT DOCUMENTS

| | | | |
|---|---|---|---|
| 3,500,897 | 3/1970 | Von Cube | 62/500 |
| 3,817,055 | 6/1974 | Hosokawa | 62/500 |
| 3,960,322 | 6/1976 | Ruff et al. | 62/2 |
| 4,023,948 | 5/1977 | Pitts et al. | 62/500 |
| 4,049,407 | 9/1977 | Bottum | 62/2 |

FOREIGN PATENT DOCUMENTS

| | | | |
|---|---|---|---|
| 1134385 | 12/1956 | France | 62/2 |

*Primary Examiner*—Lloyd L. King

*Attorney, Agent, or Firm*—Arnold G. Gulko

[57] ABSTRACT

Solar powered cooling apparatus is disclosed in which liquid refrigerant is vaporized in a collector/evaporator by solar radiations concentrated by a reflector, and the pressurized vapors operate an aspirator to reduce the pressure in an evaporator containing the same liquid refrigerant to cool the same. The mixture of vapors leaving the aspirator are condensed in a higher positioned condenser and supplied to a gathering vessel from which the liquid refrigerant is forced back into the collector/evaporator with the assist of pressurized vapors periodically withdrawn from the collector-/evaporator.

5 Claims, 2 Drawing Figures

SOLAR POWERED COOLING APPARATUS

DESCRIPTION

1. Technical Field

The present invention relates to cooling systems powered by solar radiation.

2. Background Art

Solar radiation is commonly used for heating liquids to moderate temperatures for diverse heating purposes. In some instances, more sophisticated solar powered systems have been used for the generation of electricity, and once electricity is available, it can be used for any desired purpose. However, it must be appreciated that solar powered systems are usually most practicable where the sun is strongest, and this is where cooling, not heating, is commonly the factor of greatest interest. Solar refrigeration usually requires that one first employ equipment for converting solar energy to electricity, and then this electricity can be used to operate equipment, usually including compressors, for producing the low temperature fluids needed for cooling. It is also possible to use an absorption cooling system, but such installations are sizeable and expensive and at least two pumps are required together with many controls. This invention has, as its purpose, to convert the solar energy directly into the low temperature fluids needed for cooling, and without the use of any compressor which considerably simplifies the system. The use of only a single fluid in the system is particularly contemplated, which further simplifies the needed construction.

DISCLOSURE OF INVENTION

In accordance with this invention, reflector means are used to concentrate the incident solar radiations onto a refrigerant, like Freon 11, contained in a collector/evaporator. This generates pressurized vapors which are passed through an ejector which functions as an aspirator to reduce the pressure in an evaporator containing the same refrigerant in liquid form. This reduced pressure causes the refrigerant to evaporate (boil) which lowers the temperature of the remaining liquid to provide a low temperature coolant for refrigeration purposes. The mixture of vapors leaving the ejector are cooled in a condenser to liquify the refrigerant, and this liquid refrigerant is divided into two portions to supply both the collector/evaporator and the evaporator.

In preferred practice, a portion of the vapor produced in the collector/evaporator is recycled back to provide a pressurized assist to force the liquid refrigerant into the collector/evaporator.

The invention will be more fully understood from the accompanying drawings.

Figure 1:
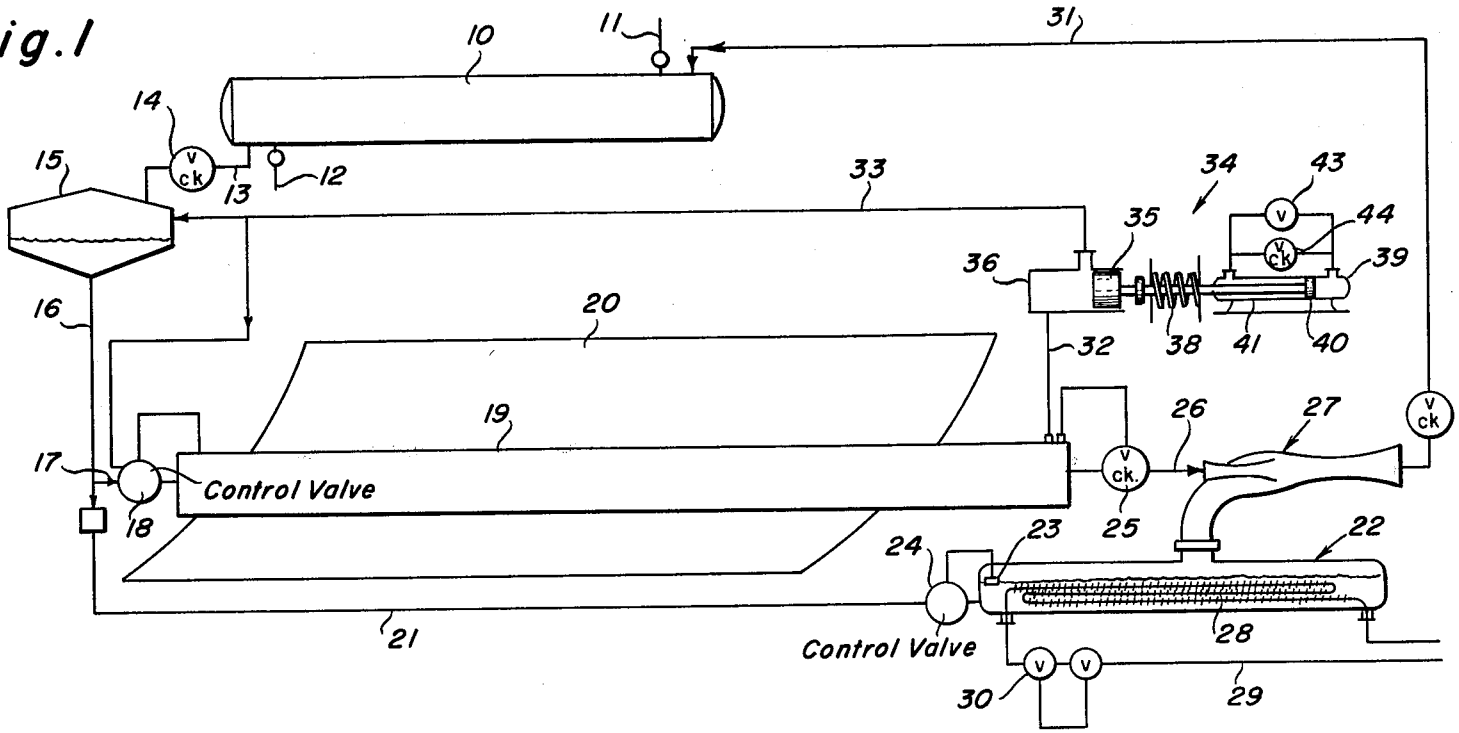
FIG. 1 is a schematic view showing the solar cooling system.

Referring more particularly to FIG. 1, it is convenient to start the consideration at the condenser 10, where cooling water entering the condenser at 11 and leaving at 12 is used to liquify the refrigerant which exits through line 13 passing through check valve 14 which prevents the pressure which intermittantly builds up in the gathering vessel 15 from passing through into the condenser 10.

The refrigerant is desirably Freon 11 since its characteristics are particularly well adapted to the system which is described herein, but many refrigerants are known and can be selected to replace Freon 11 depending upon the ambient conditions encountered and the desired temperature of refrigeration.

The refrigerant liquid shown in vessel 15 passes via lines 16 and 17 and control valve 18 into a collector-/evaporator 19 which is heated by the solar radiation concentrated by reflector 20.

As will be evident, the liquid refrigerant is evaporated and pressurized in the collector/evaporator 19, and it is necessary to overcome this pressure in order to supply liquid thereto, and this is achieved by recycling a part of the vapor which suddenly lowers the pressure in the collector/evaporator. The recycled vapor adds its pressure to the head of liquid in the gathering vessel 15. Control valve 18 opens only when the inlet pressure is about equal to or exceeds the pressure in the collector/evaporator 19. This means that the collector-/evaporator will only be supplied with liquid refrigerant periodically. At other times the refrigerant will pass through lines 16 and 21 to move toward the evaporator 22.

Evaporator 22 accepts liquid refrigerant whenever the liquid level within it falls below a predetermined level. This is detected by level control 23 which controls control valve 24. Liquid refrigerant thus moves down past check valve 25 through line 21 passing through valve 24 whenever the liquid level in the evaporator 22 falls excessively.

The vapor produced in the collector/evaporator 19 passes through a pressure-actuated control valve 25 whenever the sun produces a sufficient vapor pressure, and the pressurized gases pass through line 26 to an ejector 27 which serves as an aspirator, withdrawing vapor from evaporator 22 which reduces the pressure therein which causes the liquid in the evaporator to boil and lose heat in this way. This provides a reservoir of cooled liquid through which the coolant of an external refrigerating circuit is passed via cooling coils 28 and exit line 29 which is controlled by an optional thermostatically controlled valve 30. The details of the refrigerant circuit form no part of this invention and will not be discussed.

The pressure and temperature of the pressurized gases in line 26 are reduced by admixture with the vapors withdrawn from evaporator 22, and the mixture passes through line 31 to return to the overhead condenser 10. The term "overhead" indicates a higher position so that the liquid which gathers in vessel 15 will be above the inlet to the collector/evaporator so that a head of liquid will provide assistance in overcoming the pressure within the collector/evaporator.

The overall operation of the solar powered refrigeration system can now be described.

BEST MODE FOR CARRYING OUT THE INVENTION

Liquid refrigerant in a collector/evaporator is boiled by concentrated solar radiation to provide pressurized vapor which aspirate refrigerant vapor from an evaporator to provide a pool of cool liquid which supplies the chill needed to operate a refrigerating device. The mixture of pressurized vapor and aspirated vapor is condensed in a higher positioned or overhead condenser which drains into a gathering vessel which supplies liquid refrigerant to the evaporator whenever it needs it. The liquid refrigerant supply to the collector-/evaporator is periodic and is triggered by tapping off the pressurized gases to add to the head of liquid established by the gathering vessel to overcome the pressure which remains in the collector/evaporator.

This periodic supply of pressurized gases is obtained by periodically connecting the collector evaporator 19 with the top of the gathering vessel 15 via lines 32 and 33 which are interconnected by means of a pressure interrupting device 34.

The interrupting device 34 includes a piston 35 which moves within a cylinder 36 which receives pressurized gases through line 32. Piston 35 normally prevents the pressure in line 32 from reaching line 33, the piston being held in its closed position by a compression spring 38. As pressure builds in the collector/evaporator right after a recycle, piston 35 moves toward its open position, movement being slowed by an hydraulic brake 39.

The hydraulic brake 39 is formed by a piston 40 which moves in a cylinder 41 which interconnects with piston 35, via shaft 42. As pistons 35 and 40 move toward the open position, the hydraulic fluid in cylinder 41 slowly moves to the other side of piston 40 via metering valve 43 which determined the speed of the pistons 35 and 40. When piston 35 opens up line 33 vapor shoots through into the top of gathering vessel 15 as well as starts to actuate control valve 18 and the collector-/evaporator 19 gets a new liquid supply from vessel 15. The suddenly dropping pressure in collector/evaporator 19 as well as in cylinder 36, make pistons 35 and 40 slow down their motion, come to a stop and the reverse motion starts as the low pressure level in cylinder 36 as well as the collector/evaporator. The return movement produced by spring 38 after piston 35 is in its open position is a rapid one as the hydraulic fluid in cylinder 41 returns through the check valve 44. The volume of cylinder 36 is relatively small compared with the volume of collector/evaporator 19. So the return movement does not get slowed because pressure increase in cycle 36 caused by this return movement is virtually negligible.

Figure 2:
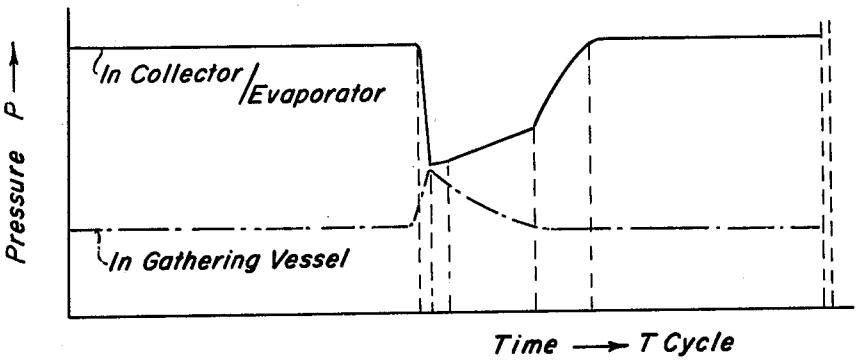
FIG. 2 is a graph in which the pressure is followed through the supply cycle to the collector/evaporator.

The cyclic supply operation is illustrated in the graph of FIG. 2 where the solid line indicates the pressure in the collector/evaporator. As can be seen this pressure is constant assuming a steady supply of solar energy. However, when piston 35 moves to the open position, there is a sudden lowering of pressure as the vapor moves rapidly through lines 32 and 33 in the absence of back pressure. After refill of the collector/evaporator 19, the pressure builds back to normal. In contrast, the dotted line shows the pressure in the gathering vessel which is normally low, except just after the piston 35 moves into its open position. Thereafter, the pressure decreases to its normal level.

Increased solar radiation shortens the cycle of the system because vapor travels faster towards ejector 27. Pressures will be at a slightly higher level in the collector/evaporator 19 and in cylinder 39 and interrupter 34 works faster at a similar rate. Start up happens if radiation becomes such that the pressure in the collector-/evaporator becomes high enough.

INDUSTRIAL APPLICABILITY

The result is a composite apparatus containing no pumps in which a single fluid is heated by concentrated solar radiation, and the product is a reservoir of cool liquid for refrigeration purposes. This particularly enables air conditioning in hot sunny climates to be obtained with a relatively simple apparatus which does not require any electrical hook-up, and without consuming large amounts of energy other than that supplied by the sun.

What is claimed is:

1. Solar powered cooling apparatus comprising a collector/evaporator and reflector means positioned to concentrate incident solar radition on the collector, an evaporator forming part of a cooling device, aspirator means operated by the pressurized refrigerant vapor produced in said collector/evaporator for reducing the pressure in the evaporator of said cooling device and thereby cooling the refrigerant liquid therein, an overhead condenser for condensing the mixture of vapors produced by said aspirator, said overhead condenser draining into an overhead gathering vessel, means for supplying liquid refrigerant from said gathering vessel to the evaporator of said cooling device, said supplying means including the head of liquid established by said gathering vessel, and means for imposing upon said head of liquid the pressure generated by said collector-/evaporator, whereby said liquid refrigerant is supplied to said collector/evaporator from said gathering vessel.

2. Solar powered cooling apparatus as recited in claim 1 in which said refrigerant liquid is Freon 11.

3. Solar powered cooling apparatus as recited in claim 1 in which a pressure actuated control valve is interposed between said collector/evaporator and said aspirator means.

4. Solar powered cooling apparatus as recited in claim 1 in which intermittently operated means interconnects said collector/evaporator with the top of said gathering vessel.

5. Solar powered cooling apparatus as recited in claim 4 in which pressurized fluid provided by said collector/evaporator operates a cylinder connected to a hydraulic brake whereby the pressurized fluid is only tapped off periodically.

* * * * *